United States Patent [19]

Carzino

[11] Patent Number: 4,699,386

[45] Date of Patent: Oct. 13, 1987

[54] SOCCER PRACTICE MACHINE

[76] Inventor: Hugo S. Carzino, 1976 Carzino Ct., Concord, Calif. 94521

[21] Appl. No.: 829,196

[22] Filed: Feb. 14, 1986

[51] Int. Cl.[4] ..... A63C 69/00

[52] U.S. Cl. ..... 273/354; 273/1 B; 273/397; 273/411

[58] Field of Search ..... 273/369, 394–397, 273/179, 182, 54 D, 411, 1 B, 354

[56] References Cited

U.S. PATENT DOCUMENTS

| | | | |
|---|---|---|---|
| 1,931,841 | 10/1933 | Evans | 273/179 D X |
| 2,334,540 | 11/1943 | Buffham | 273/179 C X |
| 3,252,705 | 5/1966 | Cornberg | 273/54 D |
| 3,599,980 | 8/1971 | Harmond et al. | 273/179 D X |
| 3,765,675 | 10/1973 | Di Marzio | 273/1 B |
| 3,794,318 | 2/1974 | Holmes | 273/1 B |
| 3,989,246 | 11/1976 | Brown et al. | 273/395 X |
| 4,272,078 | 6/1981 | Vinette | 273/397 X |
| 4,516,769 | 5/1985 | Kopp | 273/1 B |

FOREIGN PATENT DOCUMENTS

| | | | |
|---|---|---|---|
| 46634 | 4/1979 | Japan | 273/411 |
| 84/03448 | 9/1984 | World Int. Prop. O. | 273/182 R |

*Primary Examiner*—Paul E. Shapiro
*Attorney, Agent, or Firm*—Julian Caplan

[57] ABSTRACT

A soccer practice machine (10) has a planar surface (14) and a delivery tube (20) configured and positioned to deliver a soccer ball (24) proximate to the planar surface (14). A blower (26) provides sufficient air in the tube (20) for ejecting the soccer ball (24) from the delivery tube. A target (16) corresponds dimensionally to a soccer goal and is positioned remote from the delivery tube (20) and planar surface (14). A figure (42) attached to drive (44) is movably positioned in front of the target (16).

7 Claims, 4 Drawing Figures

SOCCER PRACTICE MACHINE

BACKGROUND OF THE INVENTION

1. Field of the Invention

This invention relates to a practice machine that enables a user to practice ball handling and kicking skills as employed in soccer in a realistic manner. More particularly, it relates to such a practice machine which delivers a soccer ball to the user in a manner which simulates the motion of the ball as it would come to a soccer player by means of a pass, or when the ball comes near enough to the player for an interception during a game. Most especially, it relates to such a soccer practice machine that can be incorporated into a conventional baseball batting practice cage.

2. Description of the Prior Art

Machines for allowing an individual to practice sports skills normally requiring more than one individual for effective practice, such as baseball pitching machines and tennis practice machines which serve tennis balls to the individual, are known in the art. Such machines are positioned in front of the user, such as in a cage to confine the ball after it is hit by the user, and the machines simulate a pitcher or a tennis opponent serving or returning the ball.

Particularly in the case of commercial establishments providing batting cages for baseball batting practice, the utilization of such apparatus tends to be highly seasonal. When baseball is out of season, such apparatus is underutilized, creating a financial burden for proprietors of such establishments.

For many years, soccer has been the most popular team sport in the world. In the past 20 years, the popularity of the sport has similarly been established in the United States, with the widespread organization of both youth and adult leagues. Although the United States has yet to achieve the status of a world power in soccer competition, the skill of play of U.S. teams has increased dramatically.

Given these factors, it would be highly desirable both from the standpoint of soccer participants and proprietors of establishments for practicing sports skills if machine-assisted practicing equipment could be used to assist in practicing soccer ball handling and shooting skills.

SUMMARY OF THE INVENTION

Accordingly, it is an object of this invention to provide a soccer practice machine which will deliver a soccer ball to a user under conditions comparable to which the user would receive or intercept the ball while playing soccer.

It is another object of the invention to provide such a soccer practice machine which may be adapted to conventional baseball batting cages.

It is a further object of the invention to provide such a soccer practice machine which will allow the user to practice making shots on goal with adjustable delivery of the ball to the user.

It is still another object of the invention to provide such a soccer practice machine which includes a simulation of a goalie acting to block shots on goal.

The attainment of these and related objects may be achieved through use of the novel soccer practice machine herein disclosed. A soccer practice machine in accordance with this invention has a planar surface. A means, such as a delivery tube, is configured and positioned to deliver a soccer ball proximate to the planar surface. When a delivery tube is employed for this purpose, a blower is connected to provide sufficient air in the delivery tube for ejecting the soccer ball from the delivery tube. A target corresponding dimensionally to a soccer goal is positioned in front of the planar surface away from the delivery tube or other ball delivering means. In a preferred form of the invention, a figure is movably positioned in front of the target. A means is connected to move the figure in front of the target.

In use, the delivery tube or other ball delivery means delivers a moving soccer ball to the user. The user can practice one touch shots on goal when the ball is delivered, or settle and dribble the ball if desired before shooting. If the movable figure is provided, the user must shoot the ball past the figure into the goal target. Use of this soccer practice machine enables ball handling and shooting skills to be practiced by a single person under realistic conditions.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
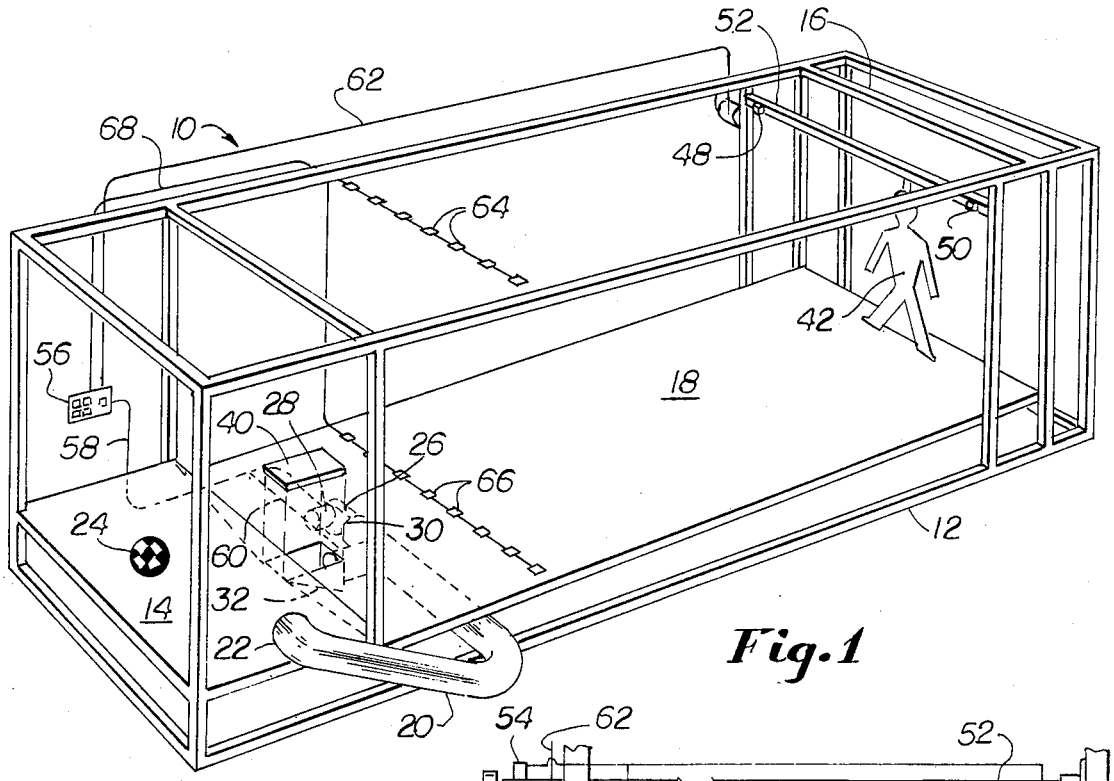
FIG. 1 is a perspective view and block diagram of a soccer practice machine in accordance with the invention.
Figure 2:
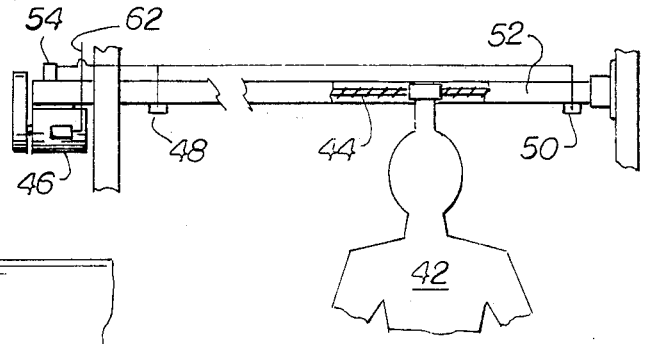
FIG. 2 is a plan view of a portion of the soccer practice machine shown in FIG. 1.
Figure 3:
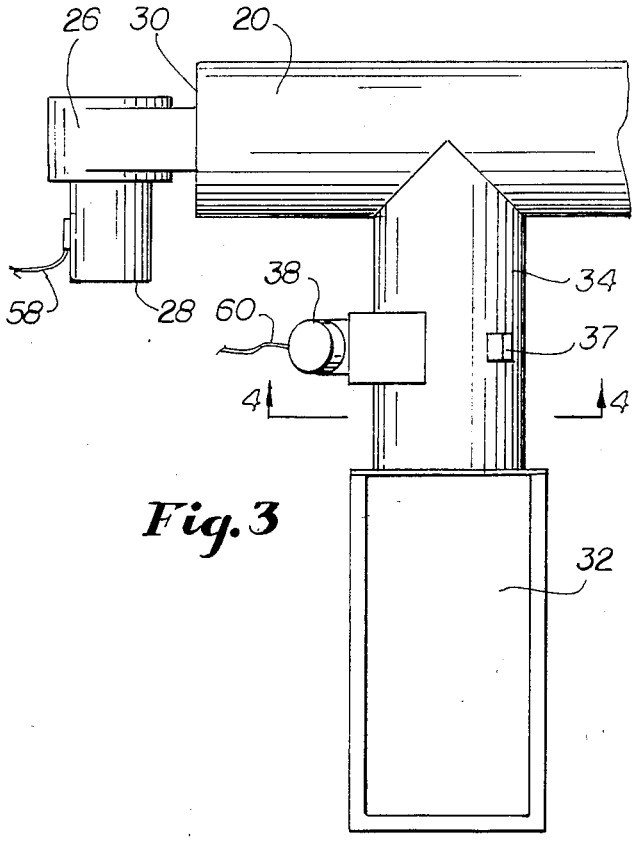
FIG. 3 is a top view of a portion of the soccer practice machine shown in FIGS. 1 and 2.
Figure 4:
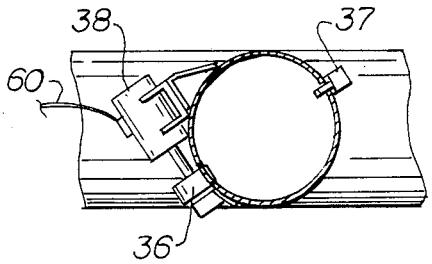
FIG. 4 is a cross-section view, taken along the line 4—4 in FIG. 3.

Turning now to the drawings, more particularly to FIGS. 1–4, there is shown a soccer practice machine 10 in accordance with the invention. The soccer practice machine 10 is incorporated in a conventional nylon netting or chain link screen enclosed batting cage. For clarity, the usual screen has not been shown around the batting cage 12. The batting cage 12 has a plaform 14 at one end and a target 16 at the other end. The target 16 corresponds to a soccer goal. It can have official dimensions, a width of 8 yards and a height of 8 feet, or other dimensions, such as a width of 16 feet and a height of 8 feet. A floor 18 extends between the platform 14 and the target 16. A delivery tube 20 extends beneath the floor 18 and to one side of the platform 14, with end 22 positioned to deliver a soccer ball 24 to the platform 14. A blower 26 driven by motor 28 is connected to end 30 of the delivery tube 20. A ball acceptance chute 32 is connected to the delivery tube 20 by tube 34. A pinch roller 36 extending into the tube 34, as shown in FIG. 4, is driven by motor 38. Floor 18 is inclined downward toward platform 14 and inward toward the ball chute 32, so that a ball 24 on the floor 18 will roll toward the ball acceptance chute 32. A removable cover 40 may be placed over the chute 32 when the apparatus is not in use.

A FIG. 42 representing a goalie is movably mounted by means of worm drive 44 in front of the target 16. Motor 46 is connected to turn the worm drive 44. A pair of microswitches 48 and 50 are mounted on bar 52 on either side of the FIG. 42 and are connected to a latching relay 54 to reverse rotation of the motor 46 when the FIG. 42 reaches one of the microswitches 48 and 50.

Control panel 56 is connected by lines 58, 60 and 62 to control operation of the motors 28, 38 and 46 respectively. Optionally, photo detectors 64 positioned on top of the cage 12 opposite mating light sources 66 are connected to the control panel 56 by line 68 in order to allow determination of the path of ball 24 when kicked toward the target 16 so that the FIG. 42 can be moved in response to the path of travel in the manner a goalie would attempt to block a shot. Such a single row of detectors will provide enough information, i.e., whether the ball is moving toward the left, right or center of the target 16 so that the FIG. 42 can be moved toward the expected point the ball will approach the target 16. If the photo detectors 64 are not employed, the FIG. 42 is simply reciprocated between the microswitches 48 and 50 with the worm drive 44.

The control panel 56 can include a microprocessor for controlling the motors 28, 38 and 46, and may include a coin slot for coin operation of the soccer practice machine 10. Optionally, control panel 56 can also control the amount of air supplied by the blower 26, so that the soccer ball 24 is ejected from the end 22 of the delivery tube 20 at different velocities for delivery to the user.

It should now be readily apparent to those skilled in the art that a novel soccer practice machine capable of achieving the stated objects of the invention has been provided. The machine 10 will deliver soccer ball 24 in a manner similar to such delivery in a soccer game, so that the user can practice ball trapping and handling and shots on goal. The configuration of the soccer practice machine 10 allows it to be installed in a conventional batting cage 12. When the soccer practice machine 10 is not being employed, the batting cage 12 can be employed for batting practice by positioning a batting machine between the platform 14 and target 16. The goalie 42 can be removed or moved beyond the microswitches 48 or 50 for such use.

It should further be apparent to those skilled in the art that various changes and details of the invention as shown and described may be made. It is intended that such changes be included within the spirit and scope of the claims appended hereto.

What is claimed is:

1. A soccer practice machine, comprising a planar surface, a delivery tube configured and positioned to deliver a soccer ball proximate to said planar surface, a blower connected to provide sufficient air in said delivery tube for ejecting the soccer ball from said delivery tube, a target corresponding dimensionally to a soccer goal positioned in front of said planar surface remote from said delivery tube, a figure movably positioned in front of said target, means connected to move the figure in front of said target, a plurality of sensors for determining a trajectory of the soccer ball, and control means connected to receive trajectory input from said plurality of sensors and to control operation of said figure moving means.

2. A soccer practice machine, comprising a planar surface, a delivery tube configured and positioned to deliver a soccer ball proximate to said planar surface, a blower connected to provide sufficient air in said delivery tube for ejecting the soccer ball from said delivery tube, a target corresponding dimensionally to a soccer goal positioned in front of said planar surface remote from said delivery tube, feed chute connected to supply the soccer ball to said delivery tube, and a pinch roller drive in said feed chute for urging the soccer ball into said delivery tube.

3. The soccer practice machine of claim 2 in which said feed chute and said delivery tube extend beneath a floor connected between said planar surface and said target, said floor being sloped to allow a soccer ball on said floor between said planar surface and said target to roll toward said feed chute and said delivery tube ejects the soccer ball at a side of said planar surface.

4. The soccer practice machine of claim 3 additionally comprising an enclosure over said planar surface and said target.

5. A soccer practice machine, comprising a planar surface, means configured and positioned to deliver a moving soccer ball proximate to said planar surface, a target corresponding dimensionally to a soccer goal positioned in front of said planar surface away from said ball delivery means, a figure movably positioned in front of said target, means connected to move the figure in front of said target, plurality of sensors for determining a trajectory of the soccer ball, and control means connected to receive trajectory input from said plurality of sensors and to control operation of said figure moving means.

6. A soccer practice machine, comprising a planar surface, means configured and positioned to deliver a moving soccer ball proximate to said planar surface, a target corresponding dimensionally to a soccer goal positioned in front of said planar surface away from said ball delivering means, a figure movably positioned in front of said target, means connected to move the figure in front of said target, a floor extending between said planar surface and said target, said ball delivering means comprising a tube extending beneath said floor and having an end positioned to eject the soccer ball at a side of said planar surface, a blower connected to provide sufficient air in said tube to eject the soccer ball from the end of said tube a feed chute beneath said floor and connected to supply the soccer ball to said tube, and a pinch roller drive in said feed chute for urging the soccer ball into said tube, said floor being sloped so that a soccer ball on said floor between said planar surface and said target will roll into said feed chute.

7. The soccer practice machine of claim 6 additionally comprising an enclosure over said planar surface and said target.

* * * * *